United States Patent [19]

Campbell et al.

[11] 4,191,087

[45] Mar. 4, 1980

[54] ROCKET DETENT AND RELEASE MECHANISM

[75] Inventors: Billy H. Campbell; Edward J. Debona; William J. Laird, all of Huntsville, Ala.

[73] Assignee: The United States of America as represented by the Secretary of the Army, Washington, D.C.

[21] Appl. No.: 933,312

[22] Filed: Aug. 14, 1978

[51] Int. Cl.[2] ..... F41F 3/04

[52] U.S. Cl. ..... 89/1.806; 89/1.816

[58] Field of Search ..... 89/1.806, 1.812, 1.807, 89/1.808, 1.8, 1.816, 1.817

[56] References Cited

U.S. PATENT DOCUMENTS

| | | | |
|---|---|---|---|
| 3,076,385 | 2/1963 | Bornhöft | 89/1.806 |
| 3,296,929 | 1/1967 | Jacobson | 89/1.806 |
| 3,505,593 | 4/1970 | Ricks et al. | 89/1.816 X |
| 3,754,726 | 8/1973 | Rusbach | 89/1.806 X |
| 3,811,360 | 5/1974 | Ricks | 89/1.807 |
| 3,962,951 | 6/1976 | Schenk | 89/1.817 X |
| 4,132,150 | 1/1979 | Conn | 89/1.806 |

FOREIGN PATENT DOCUMENTS

| | | | |
|---|---|---|---|
| 1428642 | 11/1968 | Fed. Rep. of Germany | 89/1.806 |
| 1340562 | 9/1963 | France | 89/1.806 |
| 1182275 | 2/1970 | United Kingdom | 89/1.806 |

*Primary Examiner*—David H. Brown

*Attorney, Agent, or Firm*—Nathan Edelberg; Robert P. Gibson; James T. Deaton

[57] ABSTRACT

A rocket detent and release mechanism which restrains a rocket in a launch tube during transportation of the launch tube and rocket mounted on a transporting vehicle; the detent and release mechanism is of such structure as to be released on ignition of a rocket motor of the rocket to allow the rocket to be launched, and the detent and release mechanism is fabricated and mounted such that no tools are required for engaging the detent and release mechanism when mounting the rocket in the launch tube.

17 Claims, 10 Drawing Figures

ROCKET DETENT AND RELEASE MECHANISM

DEDICATORY CLAUSE

The invention described herein may be manufactured, used, and licensed by or for the Government for governmental purposes without the payment to us of any royalties thereon.

BACKGROUND OF THE INVENTION

In rocket launchers, current detent and release mechanisms used require either a road lock that restrains the missile round during travel and must be removed prior to firing of the missile by either manual or electrical means or the detent and release mechanism includes break away devices that break at controlled tensile or shear stength after the rocket motor has been ignited and sufficient thrust has been built up to cause the break away devices to be overcome. Current detent and release mechanism that employ a road lock require an interlock to prevent firing of the rocket motor prior to release of the road lock. Also, with a road lock mechanism, the rocket must be aligned with the road lock mechanism when being inserted into the launch tube. The break away type detent and release mechanisms require special tools for installation and the break strength of the detent and release mechanism must be precisely controlled so that the break force remains constant. The break away type release mechanism also imparts large forces to the launcher structure which is not desirable.

Therefore, it is an object of this invention to provide a rocket detent and release mechanism that can be used to restrain any rocket or missile of the tube launched type.

Another object of this invention is to provide detent and release mechanism that can be used on most any size rocket but which is particularly adapted for intermediate sized rockets.

Still another object of this invention is to provide detent and release mechanism that requires no tools for mounting of the rocket in the launch tube.

A further object of this invention is to provide a detent and release mechanism in which the rocket can be inserted into the launch tube and the detent and release mechanism snapped into position as the missile is inserted into the launch tube.

Still another object of this invention is to provide a detent and release mechanism that restrains the missile in the launch tube against forward and rearward movement of the rocket until after the rocket motor has been ignited.

Still another object of this invention is to provide a detent and release mechanism that requires no external releasing means for releasing the rocket when launched.

A still further object of this invention is to provide a simplified rocket launcher which is designed to launch a multiplicity of rockets from adjacent tubes.

A still further object of this invention is to provide detent and release mechanism which releases the rocket upon ignition of the rocket motor and which imparts no forces or substantially zero forces to the launcher upon release of the mechanism.

Yet another object of this invention is to provide a detent and release mechanism that maintains the rocket in the launch tube and is only released after ignition of the rocket motor.

A still further object of this invention is to provide a detent and release mechanism that eliminates the danger of dropping a round if ignition of the rocket motor does not occur.

Other objects and advantages of this inventin will be obvious to those skilled in this art.

SUMMARY OF THE INVENTION

In accordance with this invention, rocket detent and release mechanism for launching a rocket is provided that includes a bulk head with a plurality of tubes mounted therein. Each of the tubes has mounting means for mounting the launch tube relative to the bulkhead and the mounting means have spring clips that are integral therewith for holding a rocket in the launch tube. The rocket has release mechanism connected thereto that is frangible and has surfaces that overlap with the spring clips to hold the missile in the launch tube. The release mechanism is secured to the rocket with forward detent means that cooperate with shoulders on the release mechanism and with the end of the launch tube to prevent the rocket from being launched until the release mechanism is removed. With applicants' arrangement, and the detent and release mechanism secured to the launch tube and the missile, in order to mount the missile in the launch tube for firing, all that is required is to insert the missile in to the launch tube and align the spring clips with the cooperating surfaces and sliding the missile into the launch tube until the forward detent means engage the rear end of the launch tube and the spring fingers engage the cooperating surfaces of the detent release mechanism. With this arrangement, the rocket can be mounted in the rocket launch tube and transported on its launching vehicle to the site desired and then fired from the rocket launch tube. Also, no tools are required for fastening the rocket detent and release mechanism when the rocket is inserted into the rocket launch tube.

DESCRIPTION OF PREFERRED EMBODIMENT

Figure 1:
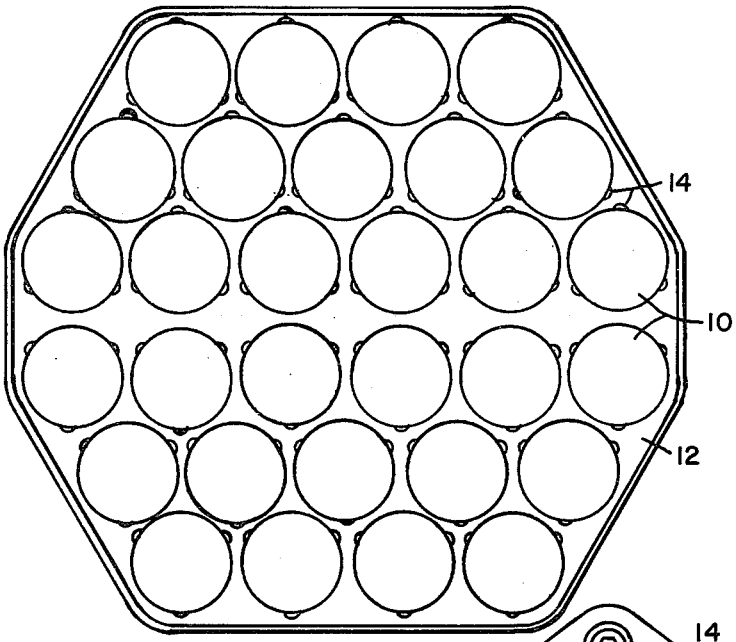
FIG. 1 is an end view of a bulk head with a multiplicity of rocket launch tubes mounted thereto.
Figure 3:
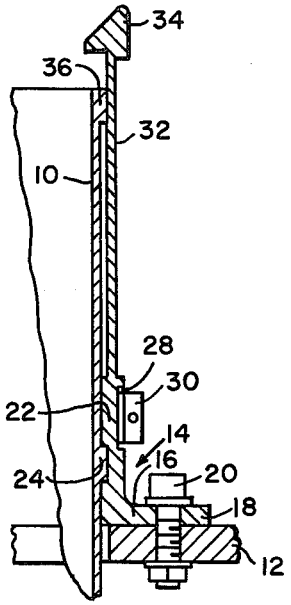
FIG. 3 is a sectional view along line 3—3 of FIG. 2.
Figure 2:
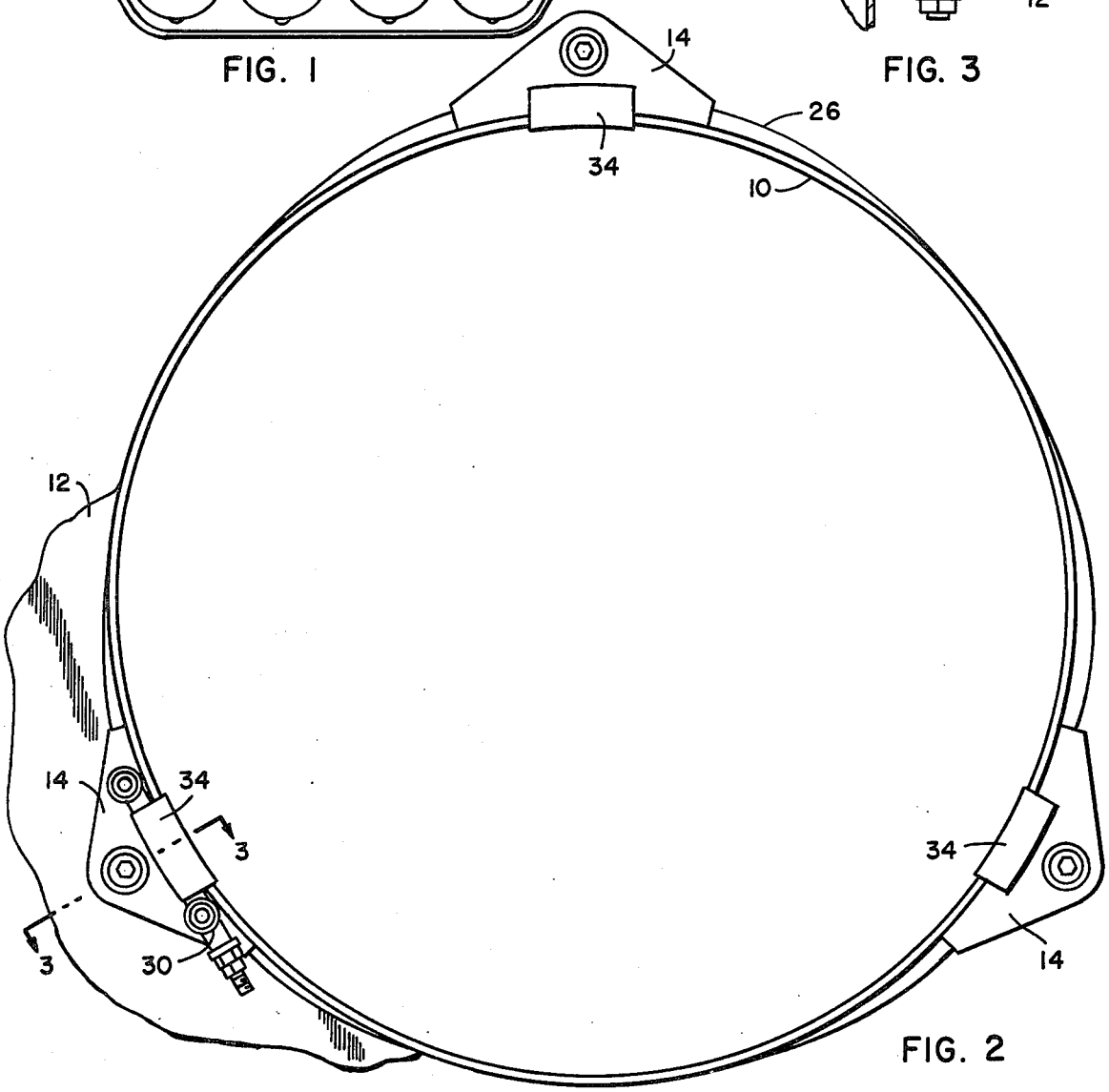
FIG. 2 is an end view of a rocket launch tube and illustrating the details of the mounting means for mounting the spring clip relative to the rocket launch tube and the rocket launch tube relative to the bulk head.
Figure 4:
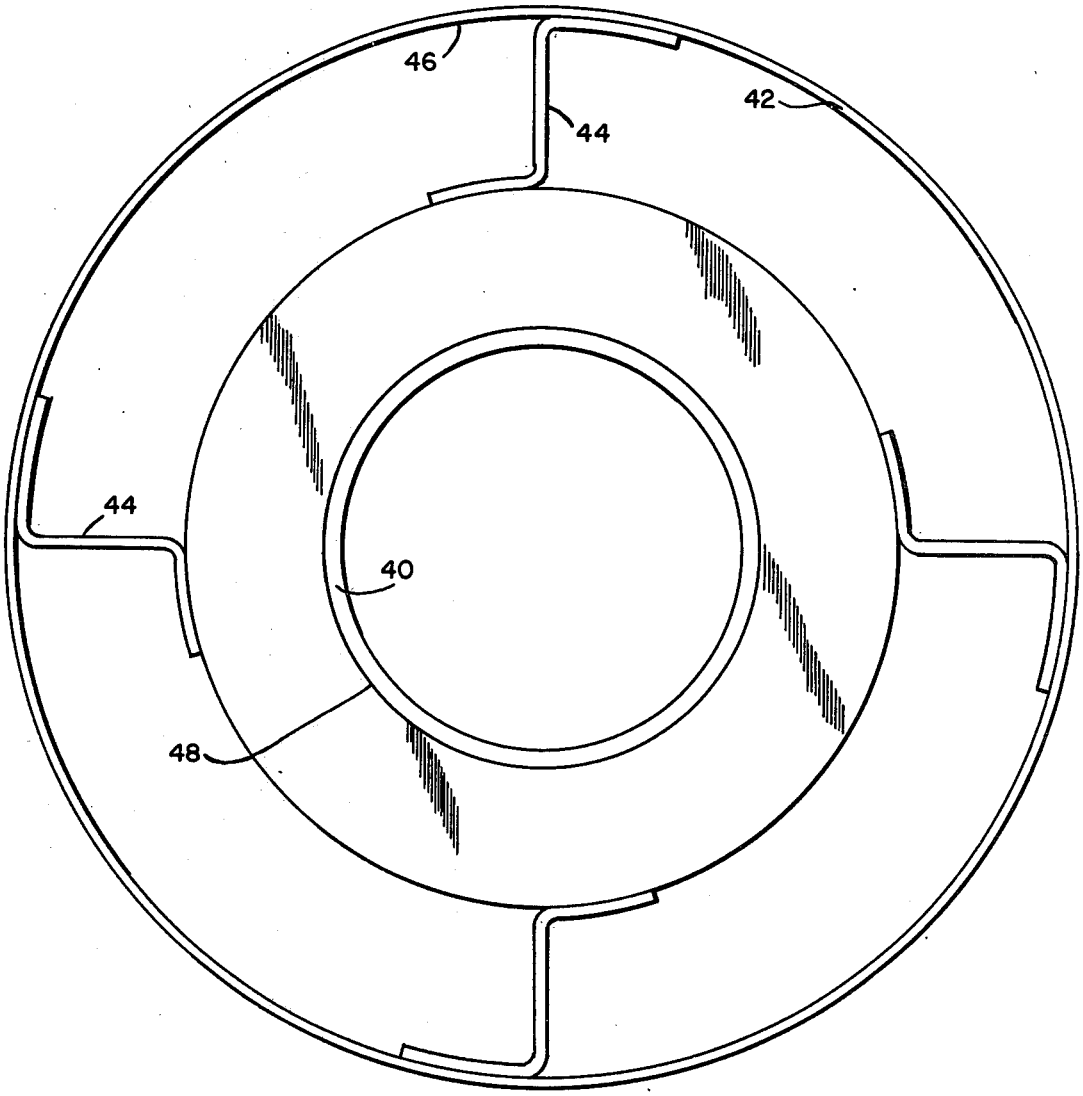
FIG. 4 is an end view of a rocket usable with the detent and release mechanism of this invention.
Figure 5:
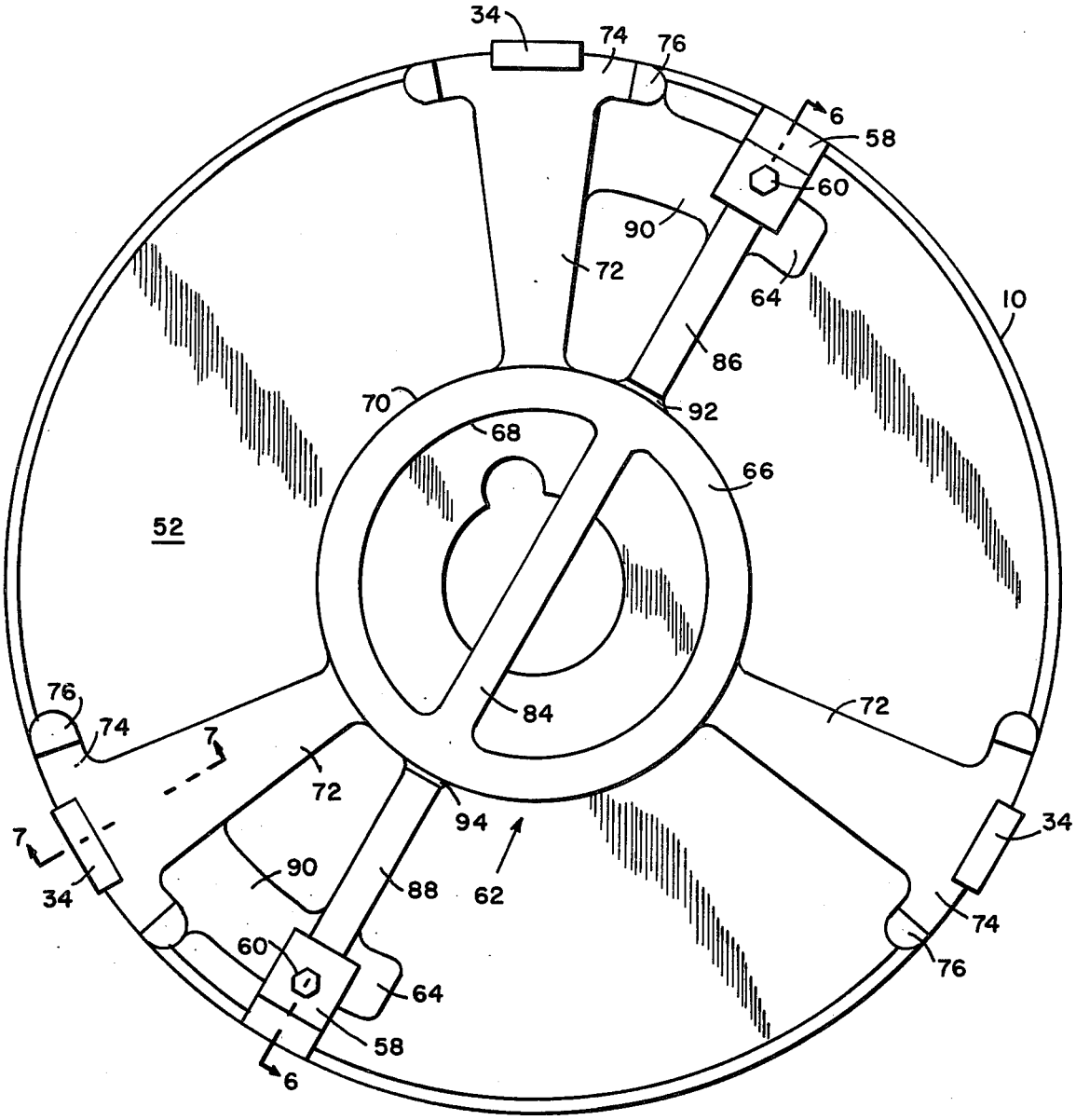
FIG. 5 is an end view with the detent and release mechanism mounted on a rocket and with the rocket inserted in a rocket launch tube.
Figure 7:
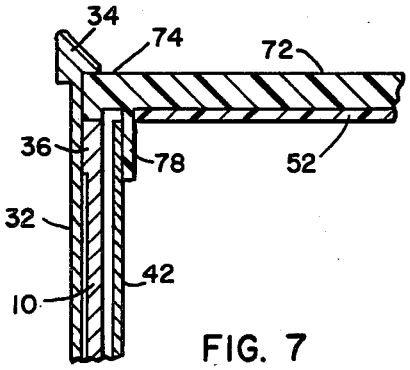
FIG. 7 is a sectional view along line 7—7 of FIG. 5.
Figure 6:
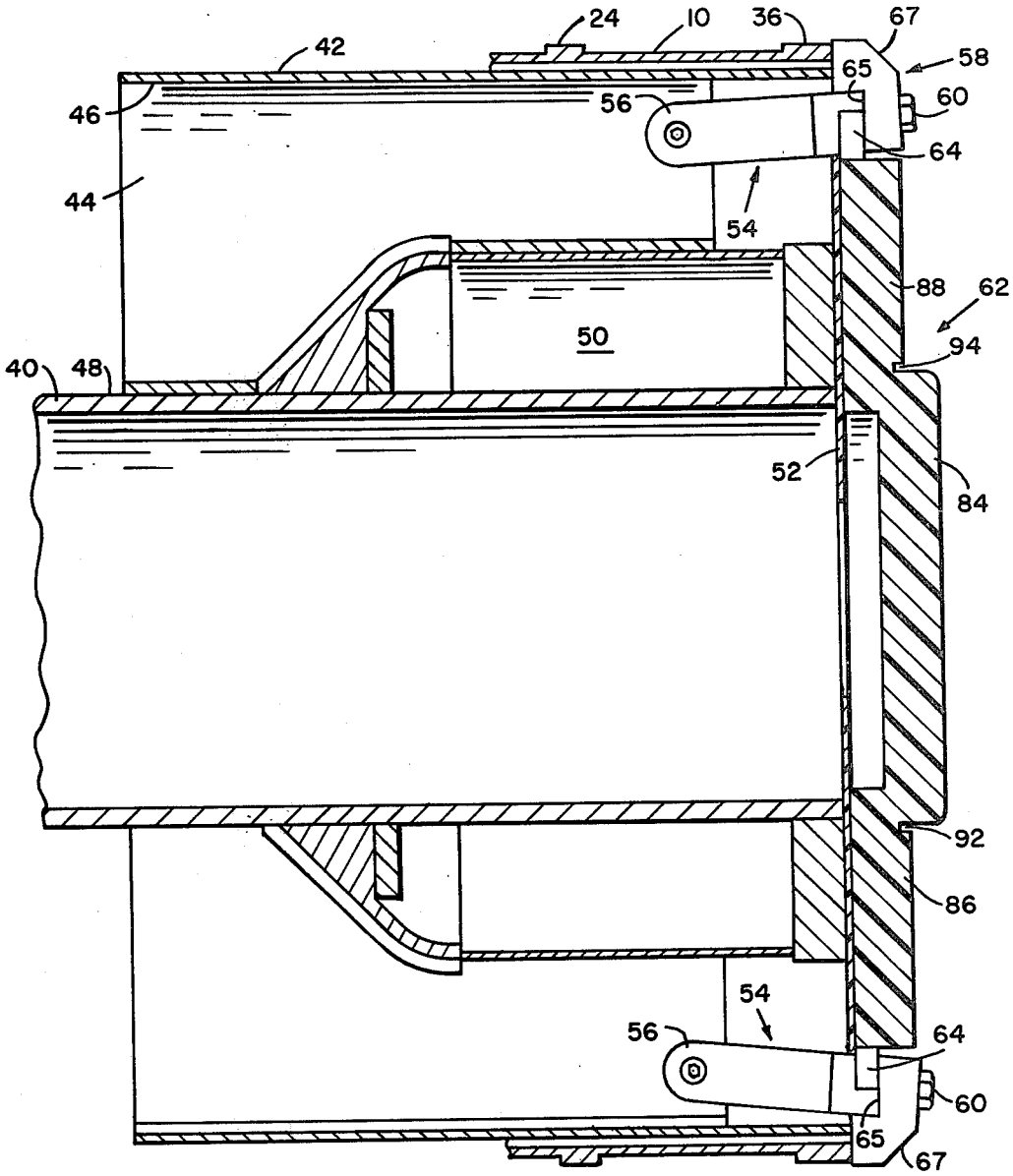
FIG. 6 is a sectional view along line 6—6 of FIG. 5.

Referring now to the drawing, FIG. 1 shows a multiplicity of rocket launch tubes 10 mounted in a bulk head 12 by mounting means 14 about the periphery of the launch tubes. Each mounting means 14 (See FIG. 2 and 3) includes structure 16 that has a flange portion 18 secured by bolt means 20 to bulk head 12, and a contoured and grooved portion 22 that coutours to the outer circumference of rocket launch tube 10 and keys with rib 24 about the periphery of rocket launch tube 10 to restrain linear movement of the launch tube longitudinally. A band 26 is placed around rocket launch tube 10 and groove 28 in each of mounting means 14 to securely clamp mounting means 14 to rocket launch tube 10. Band 26 is fastened by conventional clamping means 30 at the ends of band 26. It is pointed out that securing means 14 are located 120° apart about the periphery of rocket launch tube 10 in order to center the rocket launch tube relative to bulk head 12. Also, each mounting means 14 has a spring clip 32 that is made integral therewith with a terminating detent lip means 34. Rocket launch tube 10 also has a flange 36 at the end thereof to lend additional structural support to the rocket launch tube since the rocket launch tube is generally made of a material such as aluminum and since the end of the launch tube receives forces from the inserting of the rocket into the rocket launch tube.

Figure 8:
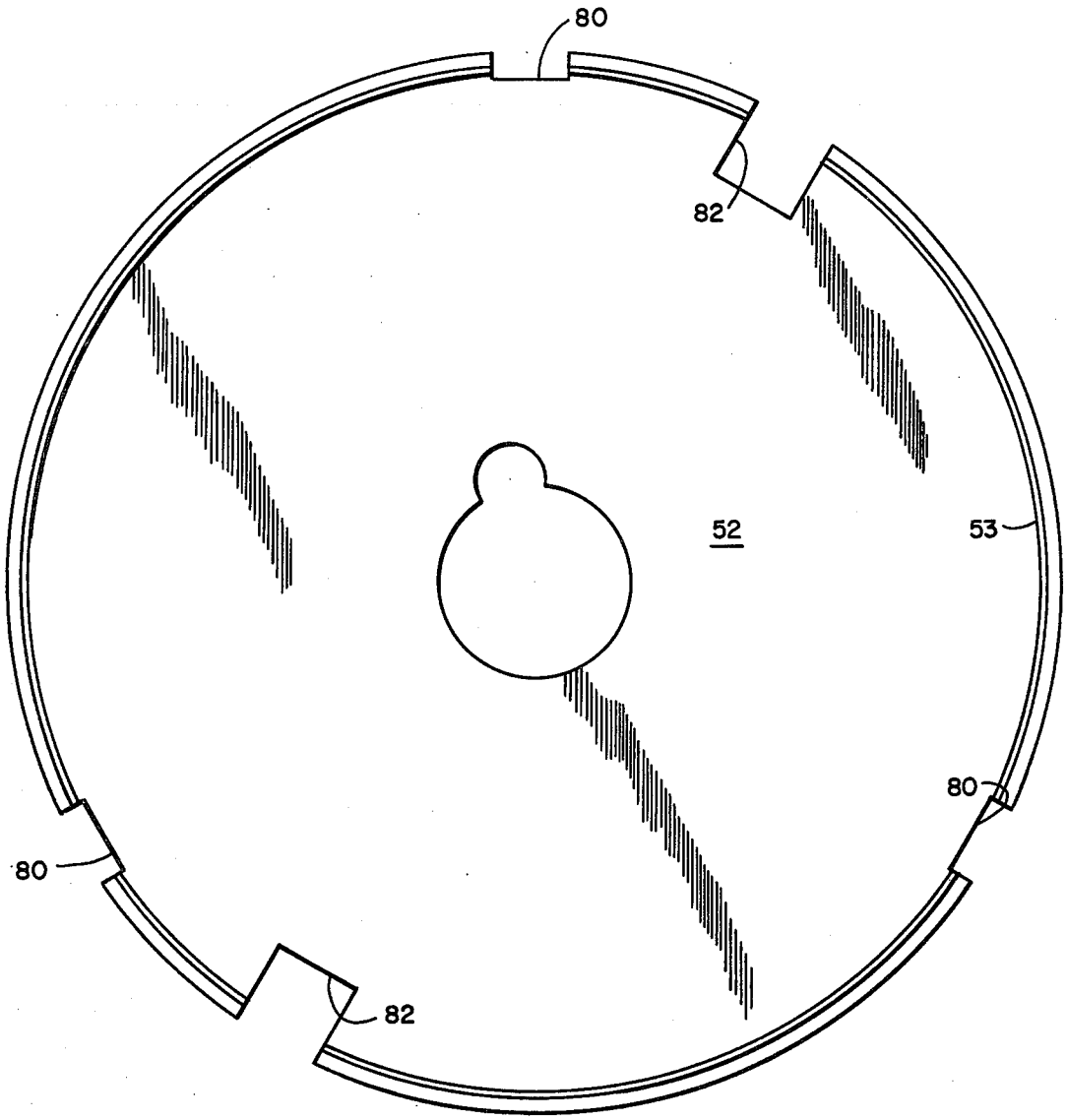
FIG. 8 is a bottom view of a cover for the end of the rocket and motor as used in this invention.
Figure 9:
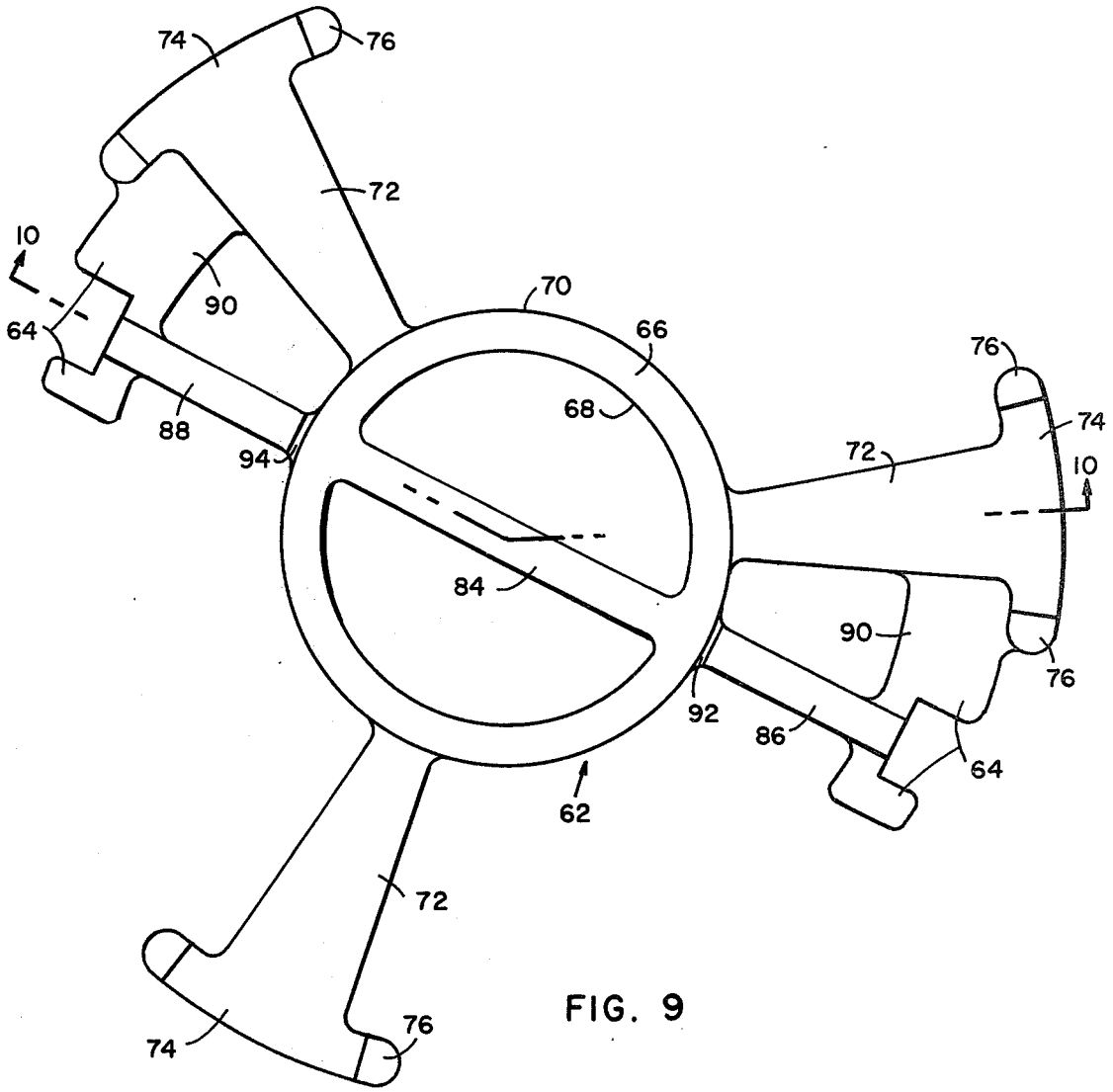
FIG. 9 is a top view of the rocket detent release mechanism in accordance with this invention.

Referring now to FIGS. 4–7, a rocket usable with this invention includes a rocket case 40 which has a ring wing 42 secured at the rear end of the rocket by fins or support means 44. Support means 44 are secured to the inner periphery 46 of ring wing 42 in a conventional manner and are secured to an outer periphery 48 of rocket case 40 in a conventional manner. If desired, the rocket can have a chamber 50 at the rear thereof for carrying appropriate means for use with the rocket and in this case, supports 44 are secured to the outer surface of the structure that forms chamber 50. A rocket motor is mounted in tube 40 in a conventional manner and is not shown on the drawings as illustrated. A rear cover 52 (See FIGS. 6 & 8) is placed over the end of rocket case 40 and ring wing 42 and is oriented relative thereto by a lip 53 (See FIG. 8) which telescopes into the end of ring wing 42. A pair of forward detent means 54 (See FIG. 6) are each pivotably secured by leg 56 to support structure or fins 44 and mounted so that they can be canted outward at a slight angle and rotatable in bound away from the launch tube when released. Each forward detent 54 has a head structure 58 which is secured to leg structure 56 by securing means 60 in a conventional manner. Detent release mechanism 62 (See FIGS. 6, 9, & 10)has shoulders 64 that are overlapped by overlapping shoulders 65 of forward detent 54 for clamping detent release mechanism 62 to the end of the rocket. Forward detents 54 also have detent portion 67 for projecting outwardly for cooperating with the end of the launch tube until released and allowed to pivot inwardly. Detent release mechanism 62 includes a ring 66 (See FIG. 9) which has inner and outer surfaces 68 and 70. Three outwardly tapering arms 72 are equally spaced about ring 66 and made integral therewith. The ends of each arm 72 has a surface 74 for cooperation with lips 34 of the spring clips mounted on the rocket launch tube to hold the rocket in the rocket launch tube. The ends of arms 72 also have raised guides 76 at opposite sides of surface 74, and the opposite sides of arms 72 have projections 78 (See FIGS. 7 & 10) for being positioned in cut-out slots 80 of cover 52. Projections 78 extend into ring wing structure 42 to orient the detent release mechanism relative to the rocket. Cover 52 also has cut-out slots 82 for accomodating head structure 58 of forward detents 54. Cover 52 can have other openings as needed. Cover 52 serves as a means for keeping out debri such as mud and snow from the rocket rearend.

Figure 10:
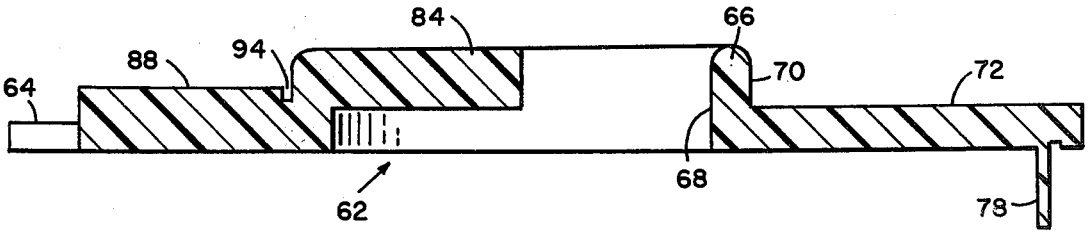
FIG. 10 is a sectional view along line 10—10 of FIG. 9.

Ring structure 66 also has an integral rib extending diametrically there across and including an inner portion 84 and rib ends 86 and 88. Rib ends 86 and 88 have the tip ends thereof made integral with arms 72 by interconnecting structure 90. Rib structure 84, 86, and 88 is thicker than arm structures 72 as illustrated in FIG. 10 and rib ends 86 and 88 have grooves 92 and 94 therein to produce a weakened area that will cause ring structure 66 to break away from rib ends 86 and 88 and arm structure 72 at the outer surface of ring 66 when predetermined force is applied to ring 66. That is, detent release mechanism 62 is made such that ring 66 and rib 84 break away as a unit.

In operation, with the launch tubes mounted relative to bulk head 12 and with the rocket having the cover and release mechanism secured thereto by forward detents 54, the rocket is slid into the launch tube until lips 34 of the rear spring clips engage surfaces 74 of the detent release mechanism to hold the missile from rearward movement out of the rocket launch tube. At the same time, detent portion 67 of forward detents 54 engage the end surface of rocket launch tube 10 to prevent further inward travel of the rocket. As can be seen, no tools are required for mounting of the rocket in the rocket launch tube and the detent release mechanism is of such substantial structure that the rocket can be transported in the rocket launch tube from site to site on its launcher. When desired to fire the rocket, the rocket engine is ignited in a conventional manner and forces from the rocket motor exhaust act on ring 66 and rib structure 84 to cause ring 66 and rib 84 to be blown out as a unit and thereby release rib ends 86 and 88 for movement inward to allow forward detents 54 to be pivoted inwardly to release detent portions 67 and allow the rocket to be launched out the forward end of the rocket launch tube. When ring 66 is blown out, arms 72 and rib ends 86 and 88 are pulled inward and disintegrated by the exhaust gases from the rocket motor. Detent release mechanism 62 must be made of a substantial structure that has high impact strength but yet will break when forces are applied at the correct position such as at ring 66. A material that has these properties and works well for the detent release mechanism is polycarbonate. Other plastic structures with similar strength characteristics could be used. As can be seen, release detent mechanism 62 is frangible when proper forces are applied to ring 66 and inner rib 84. Cover 52 is made of less substantial material than detent release mechanism 62 and can be made of plastic material such as polypropylene.

We claim:

1. A rocket device including a rocket, a rocket launch tube, forward detent means, detent release mechanism and a plurality of spring clips, all for mounting said rocket in said rocket launch tube and including said plurality of spring clips secured to the rocket launch tube and being equally spaced about the circumference of the rocket launch tube, said spring clips each having an end that extends past a rear end of the launch tube and terminating in a lip that extends radially inwardly, the rocket having said detent release mechanism secured thereto, said detent release mechanism having a plurality of surfaces that are overlapped by the lips of said spring clips to hold the rocket in the launch tube against rearward movement out the launch tube, and said detent release mechanism being secured to the rocket by said forward detent means that project outwardly of an outer surface of the rocket and overlapping an end surface of the launch tube to pervent forward movement of the rocket in the rocket launch tube, said forward detent means being held in said overlapping position by said detent release mechanism.

2. A rocket device as set forth in claim 1, wherein the rocket has a ring wing with securing means securing the ring wing to the rocket, said forward detent means being secured to the rocket by means pivotably secured to the securing means for the ring wing.

3. A rocket device as set forth in claim 1, wherein said detent release mechanism is frangible and is adapted to be removed by being broken and wherein a cover is mounted between said detent release mechanism and the rocket and held in place by said detent release mechanism.

4. A rocket device as set forth in claim 1, wherein said detent release mechanism is frangible and includes a ring structure having inner and outer surfaces, radially extending arms from said outer surface that are of equal length and equally spaced about said outer surface of said ring and being made integral with said ring, and a rib integral with said ring and extending diametrically across a diameter of said ring and extending beyond said outer surface of said ring as rib ends, whereby when forces from the exhaust of the rocket are received, said ring will be broken away from said arms and said rib ends.

5. A rocket device as set forth in claim 4, wherein said rib ends and two of said arms have integral connecting structure interconnecting ends of said rib ends to said two of said arms.

6. A rocket device as set forth in claim 5, wherein said rib ends have a groove thereacross at the intersection of said ring outer surface with said rib ends to insure that said rib ends will break at said ring outer surface when the force is applied to the ring.

7. A rocket device as set forth in claim 6, wherein said detent release mechanism is made of polycarbonate.

8. A rocket device as set forth in claim 7, wherein said arms taper outwardly from said ring and have guides at the ends to define a slot between the guides of each arm.

9. A frangible detent release mechanism comprising, a ring having inner and outer surfaces, radially extending arms from said outer surface that are of equal length and equally spaced about said outer surface of said ring and being made integral with said ring, and a rib integral with said ring and extending diametrically across a diameter of said ring and extending beyond said outer surface of said ring as rib ends, said radially extending arms and said rib ends being weakened relative to said ring, whereby when substantial force is applied to said ring, said ring will be broken away from said arms and said rib ends.

10. A frangible detent release mechanism as set forth in claim 9, wherein said arms taper outwardly from said ring.

11. A frangible detent release mechanism as set forth in claim 9, wherein said rib ends and two of said arms have integral connecting structures interconnecting ends of said rib ends to said two of said arms.

12. A frangible detent release mechanism as set forth in claim 11, wherein said rib ends are weakened relative to said ring by a groove thereacross at the interconnection of said ring outer surface with said rib ends to insure that said rib ends will break at said ring outer surface when said substantial force is applied to the ring.

13. A frangible detent release mechanism as set forth in claim 12, wherein said release mechanism is made of polycarbonate.

14. Rocket launching means comprising a bulk head having at least one opening therethrough, and a rocket launch tube positioned through said opening and mounted near one end of said bulk head, said rocket launch tube being mounted relative to said bulk head by mounting structure including circumferential keying means on an outer surface of said rocket launch tube, a plurality of support means having an inner surface contoured to fit said outer surface and key with said circumferential keying means, fastening means securing said support means to said bulk head radially of said opening and strap means about the circumference of said rocket launch tube and outer surfaces of said support means to clamp said support means to said launch tube.

15. Rocket launching means as set forth in claim 14, wherein said circumferential keying means includes a raised rib about said rocket launch tube and said support means has a groove in said inner contoured surface that fits over said rib.

16. Rocket launching means as set forth in claim 15, wherein said plurality of support means includes three, and said support means are equally spaced about said rocket launch tube.

17. Rocket launching means as set forth in claim 16, wherein each support means has a spring clip integral therewith that extends beyond a rear end of said rocket launch tube and said spring clip having detent lip means which extends radially inwardly for overlapping with structure on a rocket for holding said rocket in said launch tube.

* * * * *